US011037496B2

(12) United States Patent
Bang et al.

(10) Patent No.: US 11,037,496 B2
(45) Date of Patent: Jun. 15, 2021

(54) METHOD OF DRIVING A DISPLAY PANEL FOR AN ORGANIC LIGHT-EMITTING DISPLAY DEVICE

(71) Applicant: Samsung Display Co., Ltd., Yongin-si (KR)

(72) Inventors: Jinsook Bang, Hwaseong-si (KR); Sang Hoon Yim, Suwon-si (KR); Dong Hoon Kim, Suwon-si (KR); Byoung-Hee Park, Seoul (KR); Young Seo Park, Yongin-si (KR); Kwan Hee Lee, Suwon-si (KR); Jin Wook Jeong, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 57 days.

(21) Appl. No.: 16/659,365

(22) Filed: Oct. 21, 2019

(65) Prior Publication Data

US 2020/0175924 A1 Jun. 4, 2020

(30) Foreign Application Priority Data

Dec. 4, 2018 (KR) ..... 10-2018-0154127

(51) Int. Cl.
*G09G 5/18* (2006.01)
*G09G 3/3258* (2016.01)

(52) U.S. Cl.
CPC ... *G09G 3/3258* (2013.01); *G09G 2300/0452* (2013.01); *G09G 2310/027* (2013.01); *G09G 2310/0216* (2013.01)

(58) Field of Classification Search
CPC ... G09G 2300/0452; G09G 2310/0216; G09G 2310/027; G09G 2320/0214; G09G 2320/0233; G09G 2320/0238; G09G 3/3233; G09G 3/3258; G09G 2300/043; G09G 2320/045
USPC ..... 345/76–79
See application file for complete search history.

(56) References Cited

U.S. PATENT DOCUMENTS 10,497,757 B2 * 12/2019 Matsueda ..... H01L 27/3216
2012/0188150 A1 * 7/2012 Shirouzu ..... G09G 3/3233 345/76
2016/0005384 A1 * 1/2016 Yoon ..... G09G 3/3233 345/213

FOREIGN PATENT DOCUMENTS

KR 10-2007-0076344 A 7/2007
KR 10-0881227 B1 2/2009

* cited by examiner

*Primary Examiner* — Duc Q Dinh
(74) *Attorney, Agent, or Firm* — Lewis Roca Rothgerber Christie LLP

(57) ABSTRACT

A method of driving a display panel in an organic light-emitting display device is provided. The method determines whether a single color image is displayed on the display panel or a multiple color image is displayed on the display panel, applies an initialization voltage, for initializing an anode of an organic light-emitting element included in a non-light-emitting pixel, to the anode of the organic light-emitting element included in the non-light-emitting pixel when the multiple color image is displayed on the display panel, and applies a lateral leakage prevention voltage that is higher than the initialization voltage to an anode of an organic light-emitting element included in an adjacent non-light-emitting pixel that is located within a reference distance from a light-emitting pixel when the single color image is displayed on the display panel.

20 Claims, 11 Drawing Sheets

METHOD OF DRIVING A DISPLAY PANEL FOR AN ORGANIC LIGHT-EMITTING DISPLAY DEVICE

CROSS-REFERENCE TO RELATED APPLICATION

This application claims priority to and the benefit of Korean Patent Application No. 10-2018-0154127, filed on Dec. 4, 2018 in the Korean Intellectual Property Office (KIPO), the content of which is incorporated herein in its entirety by reference.

BACKGROUND

1. Field

Aspects of some example embodiments relate generally to an organic light-emitting display device.

2. Description of the Related Art

Generally, a display panel of an organic light-emitting display device may include first pixels each including an organic light-emitting element that outputs a first color light (e.g., a red color light), second pixels each including an organic light-emitting element that outputs a second color light (e.g., a green color light), and third pixels each including an organic light-emitting element that outputs a third color light (e.g., a blue color light). Here, when each of the pixels emits light, a driving current may flow into the organic light-emitting element via a driving transistor between a first power voltage ELVDD and a second power voltage ELVSS. On the other hand, when each of the pixels does not emit light, an initialization voltage may be applied to an anode of the organic light-emitting element to initialize the anode of the organic light-emitting element. For this reason, when a single color image, which is implemented by one of the first color light, the second color light, and the third color light, is displayed on the display panel, the anode of the organic light-emitting element included in a light-emitting pixel (e.g., a red color pixel) may have a specific voltage due to the flow of the driving current. Here, the initialization voltage that is lower than the specific voltage may be applied to the anode of the organic light-emitting element included in a non-light-emitting pixel (e.g., a blue color pixel and a green color pixel) adjacent to the light-emitting pixel. Thus, a lateral leakage current may flow between the light-emitting pixel and the non-light-emitting pixel that are adjacent to each other. For example, when a low-grayscale single color image is displayed on the display panel, an effect of relatively increasing resistance of the organic light-emitting element included in the light-emitting pixel may occur because the driving current is relatively small. Hence, an effect of relatively reducing lateral resistance (or referred to as a lateral resistor) existing between the light-emitting pixel and the non-light-emitting pixel that are adjacent to each other may occur, and thus a relatively large amount of the lateral leakage current may flow between the light-emitting pixel and the non-light-emitting pixel that are adjacent to each other. As a result, when the single color image (for example, the low-grayscale single color image) is displayed on the display panel, light-emission luminance of the light-emitting pixel may not reach desired luminance due to the lateral leakage current flowing from the light-emitting pixel into the non-light-emitting pixel or the non-light-emitting pixel may unintentionally emit light (e.g., a color shift phenomenon may occur on the single color image) due to the lateral leakage current flowing from the light-emitting pixel into the non-light-emitting pixel.

SUMMARY

Aspects of some example embodiments relate generally to an organic light-emitting display device. For example, some example embodiments of the present inventive concept relate to a method of driving a display panel of an organic light-emitting display device, where the display panel includes a plurality of pixels each including an organic light-emitting element (e.g., an organic light-emitting diode (OLED)).

Some example embodiments provide a method of driving a display panel of an organic light-emitting display device that can minimize (or reduce) a lateral leakage current flowing between a light-emitting pixel and a non-light-emitting pixel that are adjacent to each other when a single color image is displayed on the display panel.

Some example embodiments provide a method of driving a display panel of an organic light-emitting display device that can minimize (or reduce) a lateral leakage current flowing between a light-emitting pixel and a non-light-emitting pixel that are adjacent to each other when a low-grayscale single color image is displayed on the display panel.

According to an aspect of example embodiments, a method of driving a display panel in an organic light-emitting display device, the display panel including a first pixel configured to output a first color light, a second pixel configured to output a second color light, and a third pixel configured to output a third color light, the method including: determining whether or not a single color image that is implemented by one of the first color light, the second color light, and the third color light is displayed on the display panel or a multiple color image that is implemented by at least two of the first color light, the second color light, and the third color light is displayed on the display panel, applying an initialization voltage, for initializing an anode of an organic light-emitting element included in a non-light-emitting pixel, to the anode of the organic light-emitting element included in the non-light-emitting pixel when the multiple color image is displayed on the display panel, and applying a lateral leakage prevention voltage that is higher than the initialization voltage to an anode of an organic light-emitting element included in an adjacent non-light-emitting pixel that is located within a reference distance from a light-emitting pixel when the single color image is displayed on the display panel.

In example embodiments, the method may further include applying the initialization voltage to an anode of an organic light-emitting element included in a non-adjacent non-light-emitting pixel that is located outside the reference distance from the light-emitting pixel when the single color image is displayed on the display panel.

In example embodiments, applying the lateral leakage prevention voltage may include deriving a driving current that is required to flow into the organic light-emitting element for a voltage of the anode of the organic light-emitting element included in the adjacent non-light-emitting pixel to be equal to the lateral leakage prevention voltage, an operation of deriving a data voltage corresponding to the driving current, and an operation of applying the data voltage to the adjacent non-light-emitting pixel.

In example embodiments, the first color light may be a red color light, the second color light may be a green color light, and the third color light may be a blue color light.

In example embodiments, the lateral leakage prevention voltage may be lower than a predetermined low-grayscale data voltage.

In example embodiments, the lateral leakage prevention voltage applied to the first pixel, the lateral leakage prevention voltage applied to the second pixel, and the lateral leakage prevention voltage applied to the third pixel may be equal to each other.

In example embodiments, the lateral leakage prevention voltage applied to the first pixel, the lateral leakage prevention voltage applied to the second pixel, and the lateral leakage prevention voltage applied to the third pixel may be different from each other.

In example embodiments, the lateral leakage prevention voltage may configure to be constant regardless of a data voltage applied to the light-emitting pixel.

In example embodiments, the lateral leakage prevention voltage may be configured to vary according to a data voltage applied to the light-emitting pixel.

In example embodiments, the lateral leakage prevention voltage may be configured to increase as the data voltage increases, and the lateral leakage prevention voltage may be configured to decrease as the data voltage decreases.

According to another aspect of example embodiments, a method of driving a display panel in an organic light-emitting display device, where the display panel including a first pixel configured to output a first color light, a second pixel configured to output a second color light, and a third pixel configured to output a third color light, the method including determining whether or not a single color image that is implemented by one of the first color light, the second color light, and the third color light is displayed on the display panel or a multiple color image that is implemented by at least two of the first color light, the second color light, and the third color light is displayed on the display panel, applying an initialization voltage, for initializing an anode of an organic light-emitting element included in a non-light-emitting pixel, to the anode of the organic light-emitting element included in the non-light-emitting pixel when the multiple color image is displayed on the display panel or when an average grayscale of the single color image is higher than a reference low-grayscale although the single color image is displayed on the display panel, and applying a lateral leakage prevention voltage that is higher than the initialization voltage to an anode of an organic light-emitting element included in an adjacent non-light-emitting pixel that is located within a reference distance from a light-emitting pixel when the single color image is displayed on the display panel and when the average grayscale of the single color image is lower than or equal to the reference low-grayscale.

In example embodiments, the method may further include an operation of applying the initialization voltage to an anode of an organic light-emitting element included in a non-adjacent non-light-emitting pixel that is located outside the reference distance from the light-emitting pixel when the single color image is displayed on the display panel and when the average grayscale of the single color image is lower than or equal to the reference low-grayscale.

In example embodiments, applying the lateral leakage prevention voltage may include deriving a driving current that is required to flow into the organic light-emitting element for a voltage of the anode of the organic light-emitting element included in the adjacent non-light-emitting pixel to be equal to the lateral leakage prevention voltage, deriving a data voltage corresponding to the driving current, and applying the data voltage to the adjacent non-light-emitting pixel.

In example embodiments, the first color light may be a red color light, the second color light may be a green color light, and the third color light may be a blue color light.

In example embodiments, the lateral leakage prevention voltage may be lower than a predetermined low-grayscale data voltage.

In example embodiments, the lateral leakage prevention voltage applied to the first pixel, the lateral leakage prevention voltage applied to the second pixel, and the lateral leakage prevention voltage applied to the third pixel may be equal to each other.

In example embodiments, the lateral leakage prevention voltage applied to the first pixel, the lateral leakage prevention voltage applied to the second pixel, and the lateral leakage prevention voltage applied to the third pixel may be different from each other.

In example embodiments, the lateral leakage prevention voltage may configure to be constant regardless of a data voltage applied to the light-emitting pixel.

In example embodiments, the lateral leakage prevention voltage may be configured to vary according to a data voltage applied to the light-emitting pixel.

In example embodiments, the lateral leakage prevention voltage may be configured to increase as the data voltage increases, and the lateral leakage prevention voltage may be configured to decrease as the data voltage decreases.

Therefore, a method of driving a display panel according to example embodiments may minimize (or reduce) a lateral leakage current flowing between a light-emitting pixel and a non-light-emitting pixel that are adjacent to each other when a single color image is displayed on the display panel included in an organic light-emitting display device by determining whether the single color image is displayed on the display panel or a multiple color image is displayed on the display panel, by applying an initialization voltage to an anode of an organic light-emitting element included in a non-light-emitting pixel when the multiple color image is displayed on the display panel, and by applying a lateral leakage prevention voltage to an anode of an organic light-emitting element included in an adjacent non-light-emitting pixel that is located within a reference distance from a light-emitting pixel when the single color image is displayed on the display panel. As a result, the method may prevent or reduce a phenomenon in which light-emission luminance of the light-emitting pixel does not reach desired luminance due to the lateral leakage current or the non-light-emitting pixel unintentionally emits light due to the lateral leakage current.

In addition, a method of driving a display panel according to example embodiments may minimize (or reduce) a lateral leakage current flowing between a light-emitting pixel and a non-light-emitting pixel that are adjacent to each other when a single color image is displayed on the display panel included in an organic light-emitting display device by determining whether the single color image is displayed on the display panel or a multiple color image is displayed on the display panel, by applying an initialization voltage to an anode of an organic light-emitting element included in a non-light-emitting pixel when the multiple color image is displayed on the display panel or when an average grayscale of the single color image is higher than a reference low-grayscale although the single color image is displayed on the display panel, and by applying a lateral leakage prevention voltage to an anode of an organic light-emitting element included in an adjacent non-light-emitting pixel that is located within a reference distance from a light-emitting pixel when the single color image is displayed on the display panel and when the average grayscale of the single color image is lower than or equal to the reference low-grayscale. As a result, the method may prevent or reduce a phenomenon in which light-emission luminance of the light-emitting pixel does not reach desired luminance due to the lateral leakage current or the non-light-emitting pixel unintentionally emits light due to the lateral leakage current.

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, embodiments of the present inventive concept will be explained in detail with reference to the accompanying drawings.

Figure 1:
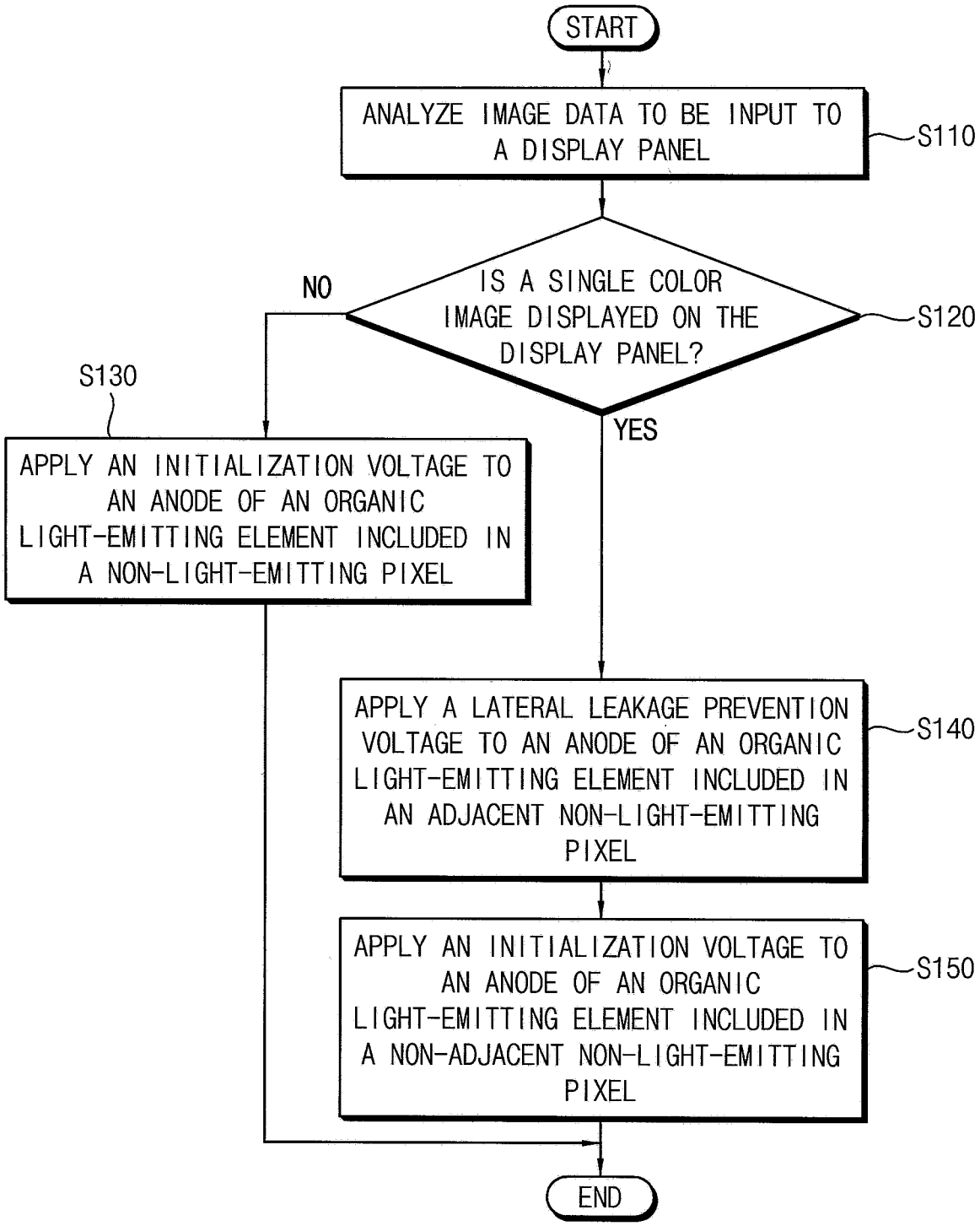
FIG. 1 is a flowchart illustrating a method of driving a display panel according to example embodiments.
Figure 2:
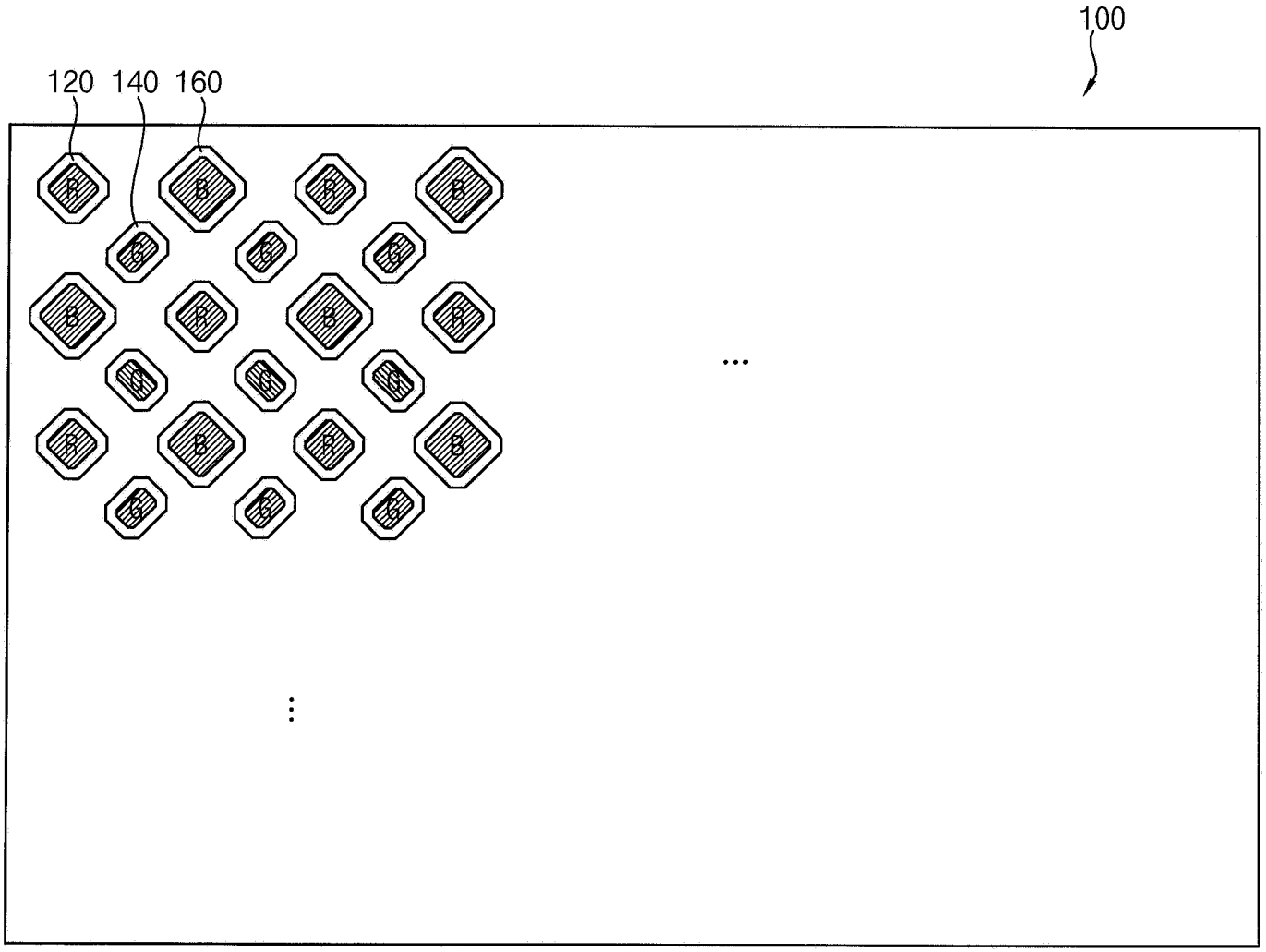
FIG. 2 is a diagram illustrating an example of a display panel to which the method of FIG. 1 is applied.
Figure 3A:
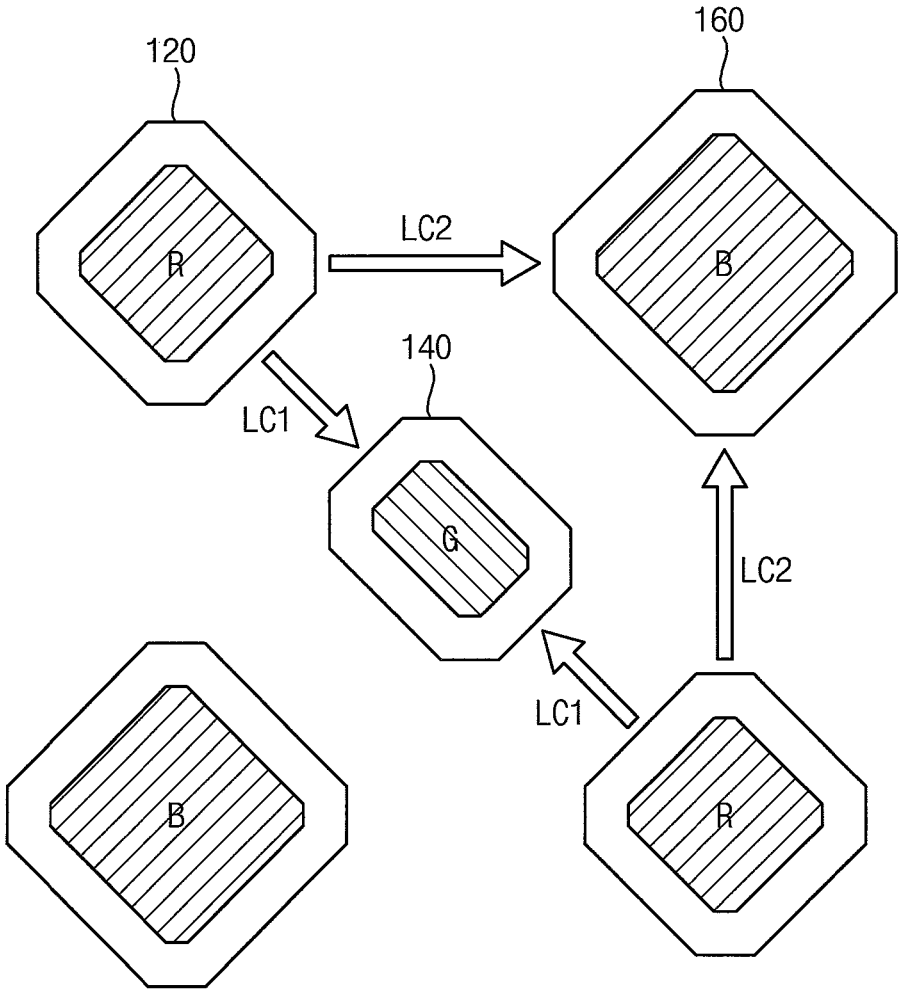
FIG. 3A (PRIOR ART)
FIGS. 3A and 3B are diagrams for describing that a lateral leakage current occurs between a light-emitting pixel and a non-light-emitting pixel when a single color image is displayed on a display panel.
Figure 3B:
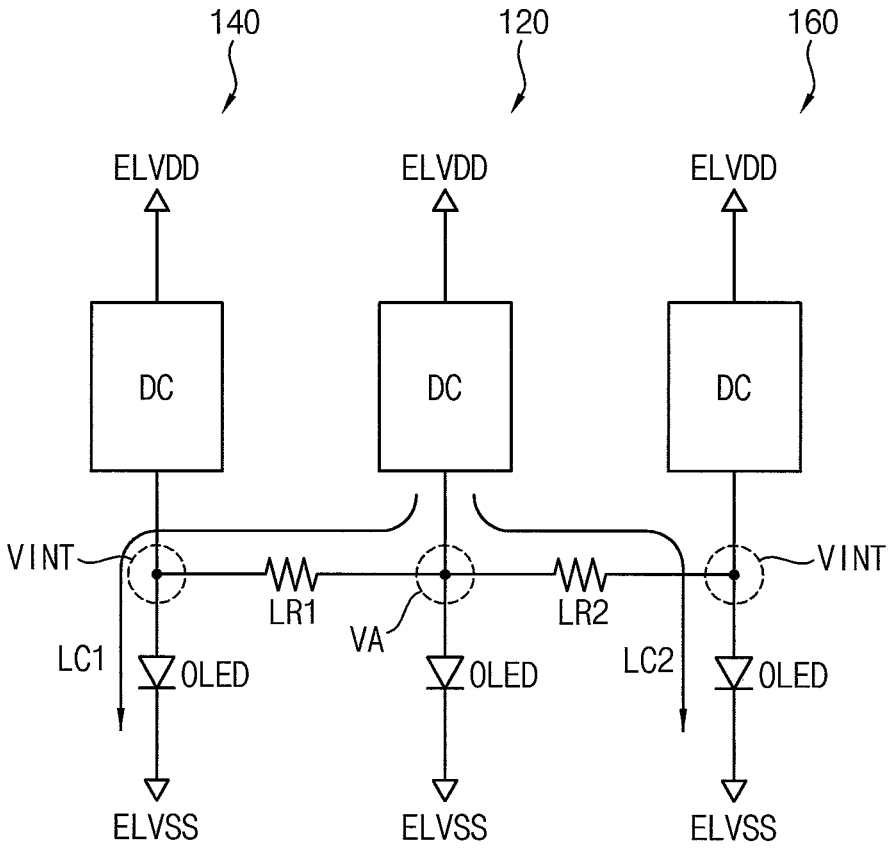
FIG. 3B (PRIOR ART)
Figure 4A:
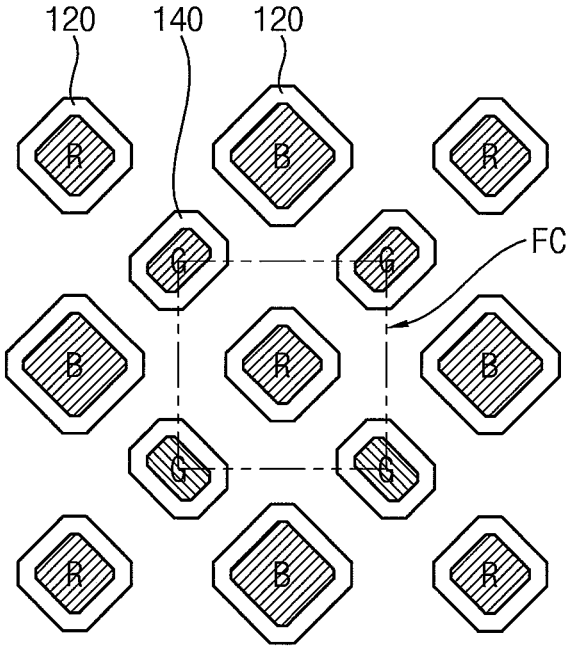
FIGS. 4A and 4B are diagrams for describing that a lateral leakage current that occurs between a light-emitting pixel and a non-light-emitting pixel when a single color image is displayed on a display panel, is reduced by the method of FIG. 1.
Figure 4B:
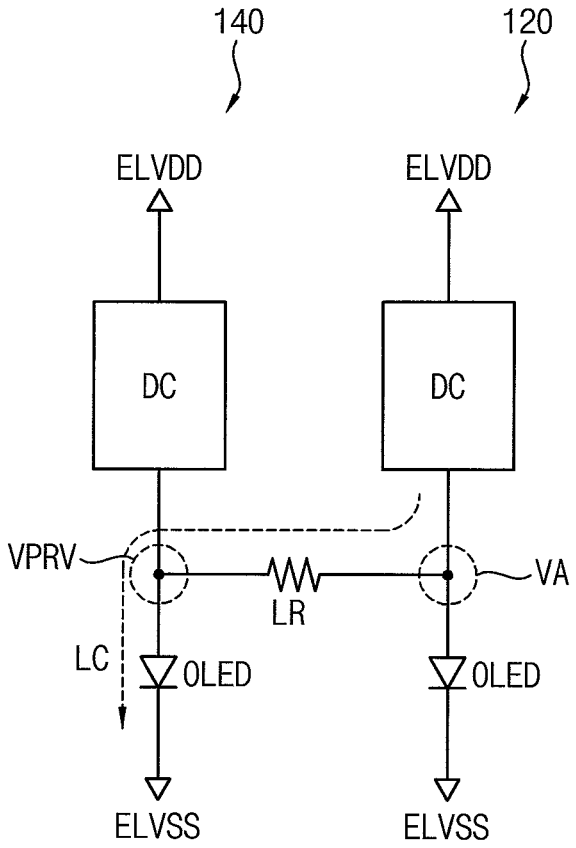

FIG. 1 is a flowchart illustrating a method of driving a display panel according to some example embodiments, FIG. 2 is a diagram illustrating an example of a display panel to which the method of FIG. 1 is applied, FIGS. 3A and 3B are diagrams for describing that a lateral leakage current occurs between a light-emitting pixel and a non-light-emitting pixel when a single color image is displayed on a display panel, and FIGS. 4A and 4B are diagrams for describing that a lateral leakage current that occurs between a light-emitting pixel and a non-light-emitting pixel when a single color image is displayed on a display panel, is reduced by the method of FIG. 1.

Figure 10:
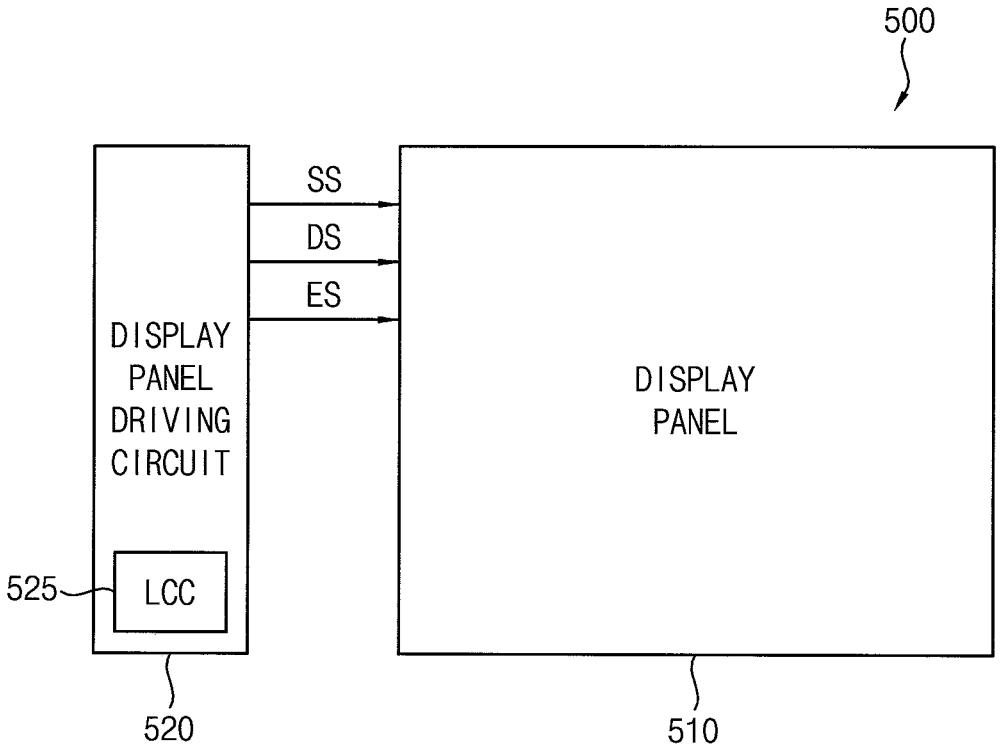
FIG. 10 is a block diagram illustrating an organic light-emitting display device according to example embodiments.

Referring to FIGS. 1-4B, the method of FIG. 1 may be applied on the display panel 100 using a processor (e.g., in some embodiment the processor may be a lateral leakage current reduction circuit in the driving circuit of the display panel as illustrated with respect to FIG. 10) included in an organic light-emitting display device, where the display panel 100 includes a first pixel 120 that outputs a first color light, a second pixel 140 that outputs a second color light, and a third pixel 160 that outputs a third color light. Here, the first pixel 120 may be one of a red color pixel that outputs a red color light, a green color pixel that outputs a green color light, and a blue color pixel that outputs a blue color light, the second pixel 140 may be another one of the red color pixel, the green color pixel, and the blue color pixel, and the third pixel 160 may be the other one of the red color pixel, the green color pixel, and the blue color pixel. For convenience of description, it will be assumed below that the first color light is the red color light (e.g., the first pixel 120 is the red color pixel R), the second color light is the green color light (e.g., the second pixel 140 is the green color pixel G), and the third color light is the blue color light (e.g., the third pixel 160 is the blue color pixel B). Specifically, according to the method of FIG. 1, a processor (e.g., in the organic light-emitting display device) may analyze image data to be input to the display panel 100 (S110), and may determine whether or not a single color image that is implemented by one of the first color light, the second color light, and the third color light is displayed on the display panel 100 or a multiple color image that is implemented by at least two of the first color light, the second color light, and the third color light is displayed on the display panel 100 (S120). At S120, if the processor determines that a single color image is not displayed on the display panel 100, the processor may apply an initialization voltage VINT, for initializing an anode of an organic light-emitting element (e.g., an organic light-emitting diode (OLED)) included in a non-light-emitting pixel (e.g., a pixel not to emit light based on the image data), to the anode of the organic light-emitting element OLED included in the non-light-emitting pixel, when the multiple color image is displayed on the display panel 100 (S130). However, at S120, if the processor determines that a single color image is displayed on the display panel 100, the processor may apply a lateral leakage prevention or reduction voltage VPRV that is higher than the initialization voltage VINT to an anode of an organic light-emitting element OLED included in an adjacent non-light-emitting pixel that is located within a set or reference distance from a light-emitting pixel (e.g., a pixel to emit light based on the image data) when the single color image is displayed on the display panel 100 (S140). In example embodiments, according to the method of FIG. 1, the processor may apply the initialization voltage VINT to an anode of an organic light-emitting element OLED included in a non-adjacent non-light-emitting pixel that is located outside the set or reference distance from the light-emitting pixel when the single color image is displayed on the display panel 100 (S150).

As illustrated in FIG. 2, the display panel 100 may include the first pixels 120 each including the organic light-emitting element OLED that outputs the red color light, the second pixels 140 each including the organic light-emitting element OLED that outputs the green color light, and the third pixels 160 each including the organic light-emitting element OLED that outputs the blue color light. Thus, the display panel 100 may display an image based on the red color light output from the first pixels 120, the green color light output from the second pixels 140, and the blue color light output from the third pixels 160. Here, as illustrated in FIGS. 3B and 4B, each of the first through third pixels 120, 140, and 160 may include the organic light-emitting element OLED and an organic light-emitting element driving circuit DC that drives the organic light-emitting element OLED. For example, the organic light-emitting element driving circuit DC may include a switching transistor, a driving transistor, an initialization transistor, a storage capacitor, etc. In the display panel 100, the first pixels 120, the second pixels 140, and the third pixels 160 may be arranged adjacent to each other. Here, the first pixels 120 may be arranged (or disposed) in a point symmetry with respect to the second pixel 140, the second pixels 140 may be arranged in a point symmetry with respect to the first pixel 120 and the third pixel 160, and the third pixels 160 may be arranged in a point symmetry with respect to the second pixel 140. For example, two first pixels 120 and two third pixels 160 may be arranged to surround one second pixel 140, two first pixels 120 may face each other with one second pixel 140 as a center, and two third pixels 160 may face each other with one second pixel 140 as a center. However, an arrangement of the first through third pixels 120, 140, and 160 in the display panel 100 is not limited thereto. That is, the arrangement of the first through third pixels 120, 140, and 160 in the display panel 100 may be designed in various manners. In addition, although it is illustrated in FIG. 2 that each of the first through third pixels 120, 140, and 160 has an octagonal shape, a shape of each of the first through third pixels 120, 140, and 160 is not limited thereto. That is, each of the first through third pixels 120, 140, and 160 may have various shapes (e.g., a tetragonal shape, a hexagon shape, an octagonal shape, etc.). Therefore, because the first pixels 120, the second pixels 140, and the third pixels 160 are arranged adjacent to each other in the display panel 100, the lateral leakage current may flow from the first pixels 120 into the second and third pixels 140 and 160 when the first pixels 120 emit light and when the second and third pixels 140 and 160 do not emit light, the lateral leakage current may flow from the second pixels 140 into the first and third pixels 120 and 160 when the second pixels 140 emit light and when the first and third pixels 120 and 160 do not emit light, and the lateral leakage current may flow from the third pixels 160 into the first and second pixels 120 and 140 when the third pixels 160 emit light and when the first and second pixels 120 and 140 do not emit light.

FIGS. 3A and 3B show that the lateral leakage current occurs between the light-emitting pixel and the non-light-emitting pixel when a red single color image is displayed on the display panel 100. As illustrated in FIGS. 3A and 3B, because only the first pixel 120 emits light when the red single color image is displayed on the display panel 100, the first pixel 120 may be the light-emitting pixel, and the second and third pixels 140 and 160 may be the non-light-emitting pixels. Thus, because a driving current flows into the organic light-emitting element OLED through the driving transistor between a first power voltage ELVDD and a second power voltage ELVSS in the first pixel 120, the anode of the organic light-emitting element OLED included in the first pixel 120 may have a specific voltage VA due to the flow of the driving current. On the other hand, in the second and third pixels 140 and 160, the initialization voltage VINT for initializing the anode of the organic light-emitting element OLED of the second and third pixels 140 and 160 may be applied to the anode of the organic light-emitting element OLED of the second and third pixels 140 and 160 (e.g., the initialization transistor that is connected between the anode of the organic light-emitting element OLED and a voltage source of the initialization voltage VINT may be turned on). Here, because the voltage (e.g., VA) of the anode of the organic light-emitting element OLED included in the first pixel 120 is higher than the voltage (e.g., VINT) of the anode of the organic light-emitting element OLED included in the second and third pixels 140 and 160, the lateral leakage current LC1 may flow from the first pixel 120 into the second pixel 140 through the lateral resistance LR1 existing between the first pixel 120 and the second pixel 140, and the lateral leakage current LC2 may flow from the first pixel 120 into the third pixel 160 through the lateral resistance LR2 existing between the first pixel 120 and the third pixel 160. For example, when the red single color image is a low-grayscale image, an effect of relatively increasing resistance of the organic light-emitting element OLED included in the first pixel 120 may occur because the driving current flowing within the first pixel 120 is relatively small. Hence, an effect of relatively reducing the lateral resistances LR1 and LR2 existing between the first pixel 120 and the second and third pixels 140 and 160 that are adjacent to each other, may occur, and thus the lateral leakage currents LC1 and LC2 may be increased. As a result, light-emission luminance of the first pixel 120 may not reach desired luminance due to the lateral leakage currents LC1 and LC2 flowing from the first pixel 120 into the second and third pixels 140 and 160 or the second and third pixels 140 and 160 may unintentionally emit light (e.g., a color shift phenomenon may occur on the red single color image) due to the lateral leakage currents LC1 and LC2 flowing from the first pixel 120 into the second and third pixels 140 and 160.

To solve the above problem, according to the method of FIG. 1, the processor may analyze the image data to be input to the display panel 100 (S110) and may determine whether or not the single color image that is implemented by one of the first color light, the second color light, and the third color light is displayed on the display panel 100 or the multiple color image that is implemented by at least two of the first color light, the second color light, and the third color light is displayed on the display panel 100 (S120). Here, the first color light may be the red color light, the second color light may be the green color light, and the third color light may be the blue color light. However, the first through third color lights are not limited thereto. When the multiple color image is displayed on the display panel 100, a portion or all of the first through third pixels 120, 140, and 160 in the display panel 100 may emit light. For example, when the red single color image is displayed on the display panel 100, a portion or all of the first pixels 120 (e.g., the red color pixels) in the display panel 100 may emit light, and all of the second and third pixels 140 and 160 (e.g., the green color pixels and the blue color pixels) may emit no light. For example, when the green single color image is displayed on the display panel 100, a portion or all of the second pixels 140 (e.g., the green color pixels) in the display panel 100 may emit light, and all of the first and third pixels 120 and 160 (e.g., the red color pixels and the blue color pixels) may emit no light. For example, when the blue single color image is displayed on the display panel 100, a portion or all of the third pixels 160 (e.g., the blue color pixels) in the display panel 100 may emit light, and all of the first and second pixels 120 and 140 (e.g., the red color pixels and the green color pixels) may emit no light.

As described above, according to the method of FIG. 1, the processor may apply the initialization voltage VINT, for initializing the anode of the organic light-emitting element OLED included in the non-light-emitting pixel, to the anode of the organic light-emitting element OLED included in the non-light-emitting pixel, when the multiple color image is displayed on the display panel 100 (S130). For example, when the multiple color image is displayed on the display panel 100, according to the method of FIG. 1, the processor may apply the initialization voltage VINT to the anode of the organic light-emitting element OLED included in non-light-emitting first pixels 120 of the first pixels 120, may apply the initialization voltage VINT to the anode of the organic light-emitting element OLED included in non-light-emitting second pixels 140 of the second pixels 140, and may apply the initialization voltage VINT to the anode of the organic light-emitting element OLED included in non-light-emitting third pixels 160 of the third pixels 160. In other words, according to the method of FIG. 1, the processor may drive the display panel 100 as described above when the multiple color image is displayed on the display panel 100. On the other hand, according to the method of FIG. 1, the processor may apply the lateral leakage prevention or reduction voltage VPRV that is higher than the initialization voltage VINT to the anode of the organic light-emitting element OLED included in the adjacent non-light-emitting pixel that is located within the set or reference distance from the light-emitting pixel when the single color image is displayed on the display panel 100 (S140). Here, the set or reference distance may be determined by considering influence between the light-emitting pixel and the non-light-emitting pixel. In an example embodiment, the lateral leakage prevention or reduction voltage VPRV may be higher than the initialization voltage VINT and may be lower than a set or predetermined low-grayscale data voltage. For example, the set or predetermined low-grayscale data voltage may be a data voltage for implementing a 5th grayscale when each of the first through third pixels 120, 140, and 160 is capable of implementing 0th to 255th grayscales. As illustrated in FIGS. 4A and 4B, when the red single color image is displayed on the display panel 100, a so-called fence FC of the adjacent non-light-emitting pixels (e.g., the second pixels 140) may be formed around the light-emitting pixel (e.g., the first pixel 120) by applying the lateral leakage prevention or reduction voltage VPRV to the adjacent non-light-emitting pixels (e.g., the second pixels 140) that are located within the set or reference distance from the light-emitting pixel (e.g., the first pixel 120). In other words, as illustrated in FIG. 4B, because a voltage difference between the voltage (e.g., VA) of the anode of the organic light-emitting element OLED of the light-emitting pixel (e.g., the first pixel 120) and the voltage (e.g., VPRV) of the anode of the organic light-emitting element OLED of the adjacent non-light-emitting pixel (e.g., the second pixel 140) is smaller than a conventional voltage difference (e.g., VA-VINT), the lateral leakage current LC flowing from the light-emitting pixel (e.g., the first pixel 120) into the adjacent non-light-emitting pixel (e.g., the second pixel 140) through the lateral resistance LR may be minimized (or reduced) as compared to related-art methods. Although it is described above that the light-emitting pixel is the first pixel 120 for convenience of description, it should be understood that the light-emitting pixel may be the second pixel 140 or the third pixel 160.

In an example embodiment, when the lateral leakage prevention or reduction voltage VPRV is applied to the adjacent non-light-emitting pixel that is located within the set or reference distance from the light-emitting pixel as the single color image is displayed on the display panel 100, the lateral leakage prevention or reduction voltage VPRV applied to the first pixel 120, the lateral leakage prevention or reduction voltage VPRV applied to the second pixel 140, and the lateral leakage prevention or reduction voltage VPRV applied to the third pixel 160, may be equal to each other. That is, the same lateral leakage prevention or reduction voltage VPRV may be applied to the adjacent non-light-emitting pixel that is located within the set or reference distance from the light-emitting pixel regardless of whether the adjacent non-light-emitting pixel is the first pixel 120, the second pixel 140, or the third pixel 160. In another example embodiment, when the lateral leakage prevention or reduction voltage VPRV is applied to the adjacent non-light-emitting pixel that is located within the set or reference distance from the light-emitting pixel as the single color image is displayed on the display panel 100, the lateral leakage prevention or reduction voltage VPRV applied to the first pixel 120, the lateral leakage prevention or reduction voltage VPRV applied to the second pixel 140, and the lateral leakage prevention or reduction voltage VPRV applied to the third pixel 160 may be different from each other. That is, a different lateral leakage prevention or reduction voltage VPRV may be applied to the adjacent non-light-emitting pixel that is located within the set or reference distance from the light-emitting pixel according to whether the adjacent non-light-emitting pixel is the first pixel 120, the second pixel 140, or the third pixel 160. The different lateral leakage prevention or reduction voltage VPRV may allow the lateral leakage currents LC1 and LC2 to be more effectively prevented by reflecting different characteristics such as light-emission efficiency among the first pixel 120, the second pixel 140, and the third pixel 160. In an example embodiment, when the lateral leakage prevention or reduction voltage VPRV is applied to the adjacent non-light-emitting pixel that is located within the set or reference distance from the light-emitting pixel as the single color image is displayed on the display panel 100, the lateral leakage prevention voltage VPRV applied to the adjacent non-light-emitting pixel may be constant regardless of a data voltage applied to the light-emitting pixel. In this case, the lateral leakage prevention or reduction voltage VPRV applied to the adjacent non-light-emitting pixel may have a fixed voltage level. In another example embodiment, when the lateral leakage prevention or reduction voltage VPRV is applied to the adjacent non-light-emitting pixel that is located within the set or reference distance from the light-emitting pixel as the single color image is displayed on the display panel 100, the lateral leakage prevention or reduction voltage VPRV applied to the adjacent non-light-emitting pixel may vary according to a data voltage applied to the light-emitting pixel. For example, the lateral leakage prevention or reduction voltage VPRV applied to the adjacent non-light-emitting pixel may increase as the data voltage applied to the light-emitting pixel increases, and the lateral leakage prevention or reduction voltage VPRV applied to the adjacent non-light-emitting pixel may decrease as the data voltage applied to the light-emitting pixel decreases. According to the method of FIG. 1, the processor may apply the initialization voltage VINT to the anode of the organic light-emitting element OLED included in the non-adjacent, non-light-emitting pixel, that is located outside the set or reference distance from the light-emitting pixel, when the single color image is displayed on the display panel 100 (S150). As described above, the set or reference distance may be determined by considering the influence between the light-emitting pixel and the non-light-emitting pixel. Thus, because the influence between the light-emitting pixel and the non-adjacent non-light-emitting pixel that is located outside the set or reference distance from the light-emitting pixel is little, according to the method of FIG. 1, the processor may apply the initialization voltage VINT to the non-adjacent non-light-emitting pixel that is located outside the set or reference distance from the light-emitting pixel.

In brief, the method of FIG. 1 may minimize (or reduce) the lateral leakage current LC flowing between the light-emitting pixel and the non-light-emitting pixel that are adjacent to each other when the single color image is displayed on the display panel 100 by determining whether the single color image is displayed on the display panel 100 or the multiple color image is displayed on the display panel 100, by applying the initialization voltage VINT to the anode of the organic light-emitting element OLED included in the non-light-emitting pixel when the multiple color image is displayed on the display panel 100, and by applying the lateral leakage prevention or reduction voltage VPRV to the anode of the organic light-emitting element OLED included in the adjacent non-light-emitting pixel that is located within the set or reference distance from the light-emitting pixel when the single color image is displayed on the display panel 100. Thus, the method of FIG. 1 may prevent or reduce a phenomenon in which light-emission luminance of the light-emitting pixel does not reach desired luminance due to the lateral leakage current LC or the non-light-emitting pixel unintentionally emits light due to the lateral leakage current LC. As a result, the organic light-emitting display device employing the method of FIG. 1 may provide a high-quality image to a viewer (or user).

Figure 5:
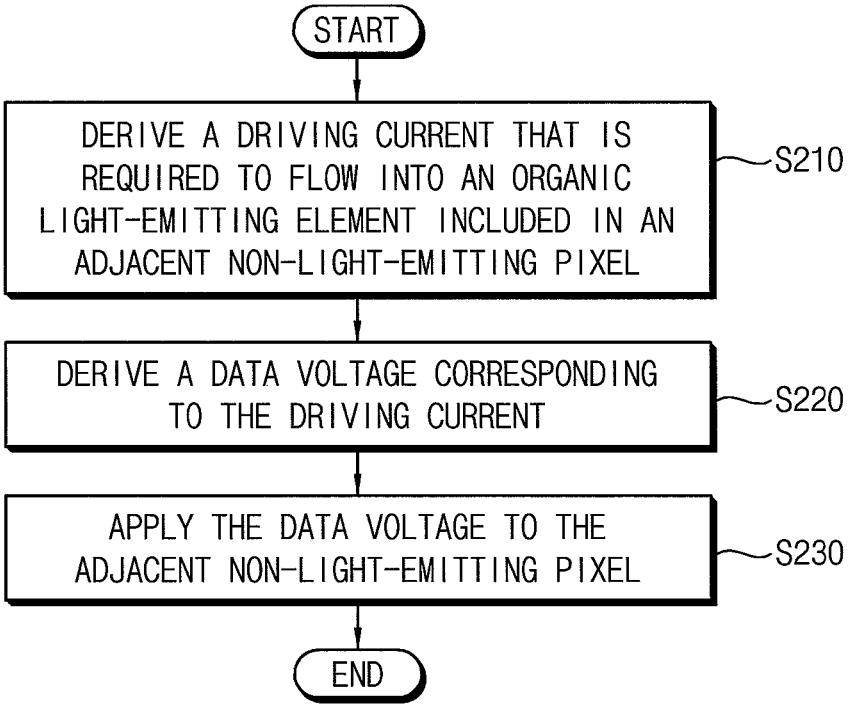
FIG. 5 is a flowchart illustrating an example in which a lateral leakage prevention or reduction voltage is applied according to the method of FIG. 1 to an anode of an organic light-emitting element included in an adjacent non-light-emitting pixel that is located within a set or reference distance from a light-emitting pixel.

FIG. 5 is a flowchart illustrating an example in which a lateral leakage prevention or reduction voltage is applied according to the method of FIG. 1 to an anode of an organic light-emitting element included in an adjacent non-light-emitting pixel that is located within a set or reference distance from a light-emitting pixel.

Referring to FIG. 5, the processor may apply the lateral leakage prevention or reduction voltage VPRV, according to the method of FIG. 1, to the anode of the organic light-emitting element OLED included in the adjacent non-light-emitting pixel that is located within the set or reference distance from the light-emitting pixel when the single color image is displayed on the display panel 100. Specifically, according to the method of FIG. 1, the processor may derive a driving current that is required to flow into the organic light-emitting element OLED included in the adjacent non-light-emitting pixel for a voltage of the anode of the organic light-emitting element OLED included in the adjacent non-light-emitting pixel to be equal to the lateral leakage prevention or reduction voltage VPRV (S210). For example, according to the method of FIG. 1, the processor may estimate, based on resistance of the organic light-emitting element OLED included in the adjacent non-light-emitting pixel, the driving current that is required to flow into the organic light-emitting element OLED included in the adjacent non-light-emitting pixel for the voltage of the anode of the organic light-emitting element OLED included in the adjacent non-light-emitting pixel to be equal to the lateral leakage prevention or reduction voltage VPRV. Next, according to the method of FIG. 1, the processor may derive a data voltage corresponding to the driving current (S220). For example, according to the method of FIG. 1, the processor may determine the data voltage corresponding to the driving current using a mapping table that stores the driving currents flowing into the organic light-emitting element OLED included in each of the first through third pixels 120, 140, and 160 and corresponding data voltages applied to each of the first through third pixels 120, 140, and 160 matched thereto. Here, when each of the first through third pixels 120, 140, and 160 is capable of implementing 0th through 255th grayscales, according to the method of FIG. 1, the processor may enlarge a grayscale range from a grayscale range between the 0th grayscale and the 255th grayscale to a grayscale range between the 0th grayscale and the (255+k)th grayscale, where k is an integer greater than or equal to 1, may allocate a data voltage for light-emission to a grayscale range between the (k)th grayscale and the (255+k)th grayscale, and then may allocate the data voltage for applying the lateral leakage prevention or reduction voltage VPRV to a grayscale range between the 0th grayscale and the (k−1)th grayscale. Subsequently, according to the method of FIG. 1, the processor may apply the lateral leakage prevention or reduction voltage VPRV to the anode of the organic light-emitting element OLED included in the adjacent non-light-emitting pixel by applying the data voltage to the adjacent non-light-emitting pixel (S230).

Figure 6:
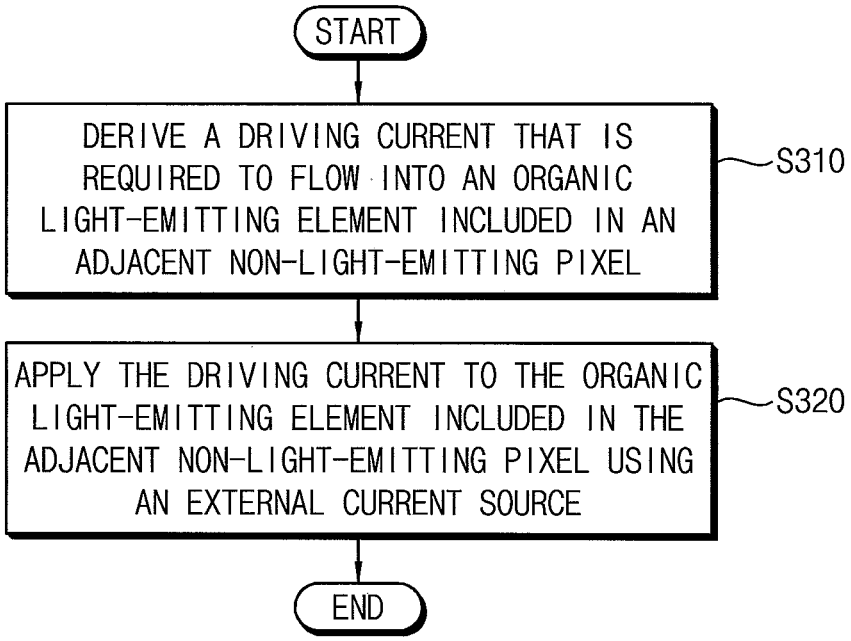
FIG. 6 is a flowchart illustrating another example in which a lateral leakage prevention or reduction voltage is applied according to the method of FIG. 1 to an anode of an organic light-emitting element included in an adjacent non-light-emitting pixel that is located within a set or reference distance from a light-emitting pixel.

FIG. 6 is a flowchart illustrating another example in which a lateral leakage prevention voltage is applied according to the method of FIG. 1 to an anode of an organic light-emitting element included in an adjacent non-light-emitting pixel that is located within a set or reference distance from a light-emitting pixel.

Referring to FIG. 6, the processor may apply the lateral leakage prevention or reduction voltage VPRV, according to the method of FIG. 1, to the anode of the organic light-emitting element OLED included in the adjacent non-light-emitting pixel, that is located within the set or reference distance from the light-emitting pixel, when the single color image is displayed on the display panel 100. Specifically, according to the method of FIG. 1, the processor may derive a driving current that is required to flow into the organic light-emitting element OLED included in the adjacent non-light-emitting pixel for a voltage of the anode of the organic light-emitting element OLED included in the adjacent non-light-emitting pixel to be equal to the lateral leakage prevention or reduction voltage VPRV (S310). For example, according to the method of FIG. 1, the processor may estimate, based on resistance of the organic light-emitting element OLED included in the adjacent non-light-emitting pixel, the driving current that is required to flow into the organic light-emitting element OLED included in the adjacent non-light-emitting pixel for the voltage of the anode of the organic light-emitting element OLED included in the adjacent non-light-emitting pixel to be equal to the lateral leakage prevention or reduction voltage VPRV. Next, according to the method of FIG. 1, the processor may apply the driving current to the organic light-emitting element OLED included in the adjacent non-light-emitting pixel using an external current source (S320). For example, the anode of the organic light-emitting element OLED included in the adjacent non-light-emitting pixel may be connected to the external current source via a specific transistor, and the external current source may provide the driving current to the organic light-emitting element OLED included in the adjacent non-light-emitting pixel when the transistor is turned on. Thus, the driving current may flow into the organic light-emitting element OLED included in the adjacent non-light-emitting pixel, and thus the lateral leakage prevention or reduction voltage VPRV may be applied to the anode of the organic light-emitting element OLED included in the adjacent non-light-emitting pixel.

Figure 7:
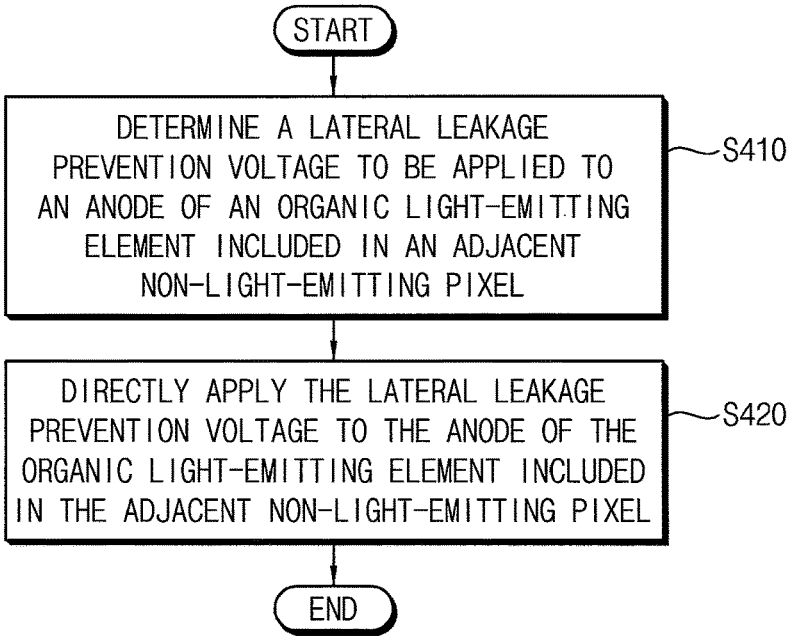
FIG. 7 is a flowchart illustrating still another example in which a lateral leakage prevention or reduction voltage is applied according to the method of FIG. 1 to an anode of an organic light-emitting element included in an adjacent non-light-emitting pixel that is located within a set or reference distance from a light-emitting pixel.

FIG. 7 is a flowchart illustrating still another example in which a lateral leakage prevention or reduction voltage is applied according to the method of FIG. 1 to an anode of an organic light-emitting element included in an adjacent non-light-emitting pixel that is located within a set or reference distance from a light-emitting pixel.

Referring to FIG. 7, the processor may apply the lateral leakage prevention or reduction voltage VPRV, according to the method of FIG. 1, to the anode of the organic light-emitting element OLED included in the adjacent non-light-emitting pixel that is located within the set or reference distance from the light-emitting pixel when the single color image is displayed on the display panel 100. Specifically, according to the method of FIG. 1, the processor may determine the lateral leakage prevention or reduction voltage VPRV to be applied to the anode of the organic light-emitting element OLED included in the adjacent non-light-emitting pixel that is located within the set or reference distance from the light-emitting pixel (S410). For example, according to the method of FIG. 1, the processor may calculate the lateral leakage prevention or reduction voltage VPRV to be applied to the anode of the organic light-emitting element OLED included in the adjacent non-light-emitting pixel by considering a data voltage to be applied to the light-emitting pixel, characteristics (e.g., light-emission efficiency, etc.) of the adjacent non-light-emitting pixel, etc. Next, according to the method of FIG. 1, the processor may directly apply the lateral leakage prevention or reduction voltage VPRV to the anode of the organic light-emitting element OLED included in the adjacent non-light-emitting pixel using an external voltage source (S420). For example, the anode of the organic light-emitting element OLED included in the adjacent non-light-emitting pixel may be connected to the external voltage source via a specific transistor, and the external voltage source may directly apply the lateral leakage prevention or reduction voltage VPRV to the anode of the organic light-emitting element OLED included in the adjacent non-light-emitting pixel when the transistor is turned on. Thus, the lateral leakage prevention or reduction voltage VPRV may be applied to the anode of the organic light-emitting element OLED included in the adjacent non-light-emitting pixel.

Figure 8:
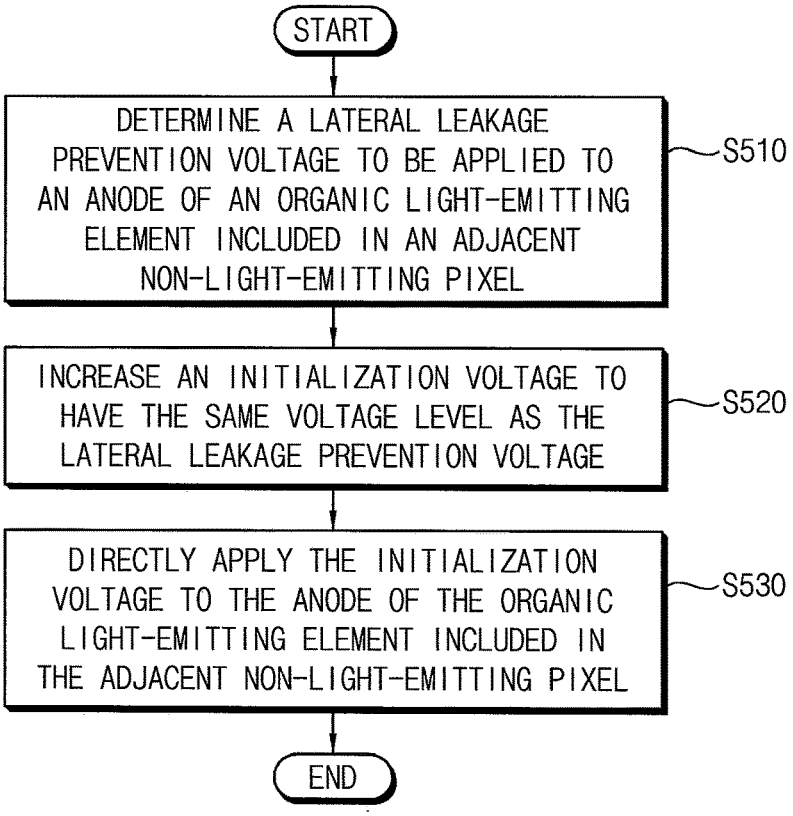
FIG. 8 is a flowchart illustrating still another example in which a lateral leakage prevention or reduction voltage is applied according to the method of FIG. 1 to an anode of an organic light-emitting element included in an adjacent non-light-emitting pixel that is located within a set or reference distance from a light-emitting pixel.

FIG. 8 is a flowchart illustrating still another example in which a lateral leakage prevention or reduction voltage is applied according to the method of FIG. 1 to an anode of an organic light-emitting element included in an adjacent non-light-emitting pixel that is located within a set or reference distance from a light-emitting pixel.

Referring to FIG. 8, the processor may apply the lateral leakage prevention or reduction voltage VPRV, according to the method of FIG. 1, to the anode of the organic light-emitting element OLED included in the adjacent non-light-emitting pixel that is located within the set or reference distance from the light-emitting pixel when the single color image is displayed on the display panel 100. Specifically, according to the method of FIG. 1, the processor may determine the lateral leakage prevention or reduction voltage VPRV to be applied to the anode of the organic light-emitting element OLED included in the adjacent non-light-emitting pixel that is located within the set or reference distance from the light-emitting pixel (S510). For example, according to the method of FIG. 1, the processor may calculate the lateral leakage prevention or reduction voltage VPRV to be applied to the anode of the organic light-emitting element OLED included in the adjacent non-light-emitting pixel by considering a data voltage to be applied to the light-emitting pixel, characteristics (e.g., light-emission efficiency, etc.) of the adjacent non-light-emitting pixel, etc. Next, according to the method of FIG. 1, the processor may increase the initialization voltage VINT to have the same voltage level as the lateral leakage prevention or reduction voltage VPRV (S520) and may directly apply the initialization voltage VINT to the anode of the organic light-emitting element OLED included in the adjacent non-light-emitting pixel (S530). For example, the anode of the organic light-emitting element OLED included in the adjacent non-light-emitting pixel may be connected to a voltage source of the initialization voltage VINT via an initialization transistor, and the voltage source may directly apply the initialization voltage VINT adjusted to have the same voltage level as the lateral leakage prevention or reduction voltage VPRV to the anode of the organic light-emitting element OLED included in the adjacent non-light-emitting pixel when the initialization transistor is turned on. Thus, the lateral leakage prevention or reduction voltage VPRV may be applied to the anode of the organic light-emitting element OLED included in the adjacent non-light-emitting pixel.

Figure 9:
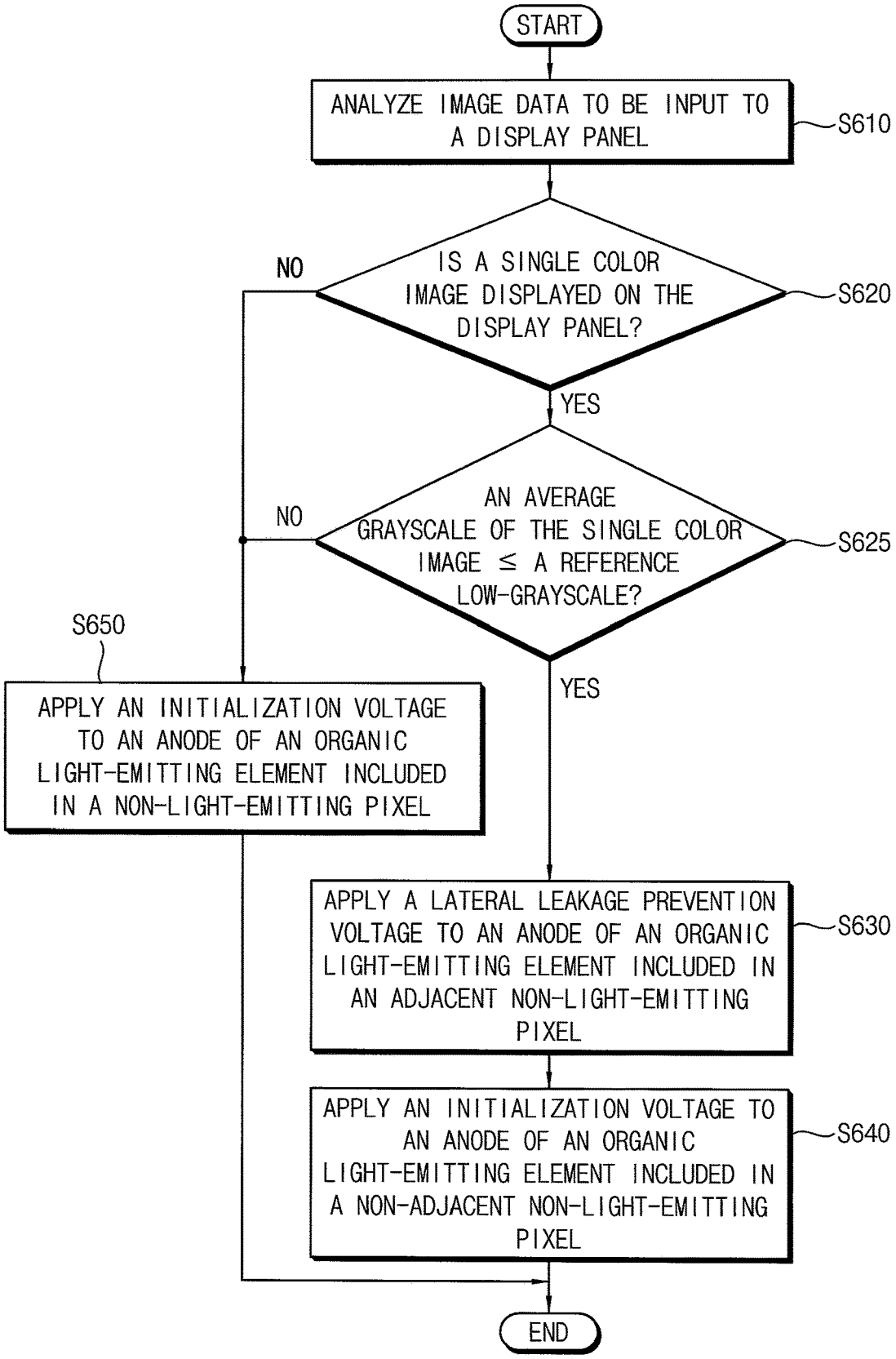
FIG. 9 is a flowchart illustrating a method of driving a display panel according to example embodiments.

FIG. 9 is a flowchart illustrating a method of driving a display panel according to example embodiments.

Referring to FIG. 9, the method of FIG. 9 may be applied on the display panel using a processor (e.g., in some embodiment the processor may be a lateral leakage current reduction circuit in the driving circuit of the display panel as illustrated with respect to FIG. 10) included in an organic light-emitting display device, where the display panel includes a first pixel that outputs a first color light, a second pixel that outputs a second color light, and a third pixel that outputs a third color light. Here, the first pixel may be one of a red color pixel that outputs a red color light, a green color pixel that outputs a green color light, and a blue color pixel that outputs a blue color light, the second pixel may be another one of the red color pixel, the green color pixel, and the blue color pixel, and the third pixel may be the other one of the red color pixel, the green color pixel, and the blue color pixel. The method of FIG. 9 may be substantially the same as the method of FIG. 1, except that the method of FIG. 9 performs operations by classifying a single color image displayed on the display panel into a low-grayscale single color image and a non-low-grayscale single color image. Thus, duplicated description will not be repeated in describing the method of FIG. 9.

Specifically, according to the method of FIG. 9, the processor may analyze image data to be input to the display panel (S610) and may determine whether a single color image that is implemented by one of the first color light, the second color light, and the third color light is displayed on the display panel or a multiple color image that is implemented by at least two of the first color light, the second color light, and the third color light is displayed on the display panel (S620). Here, according to the method of FIG. 9, the processor may apply an initialization voltage for initializing an anode of an organic light-emitting element included in a non-light-emitting pixel to the anode of the organic light-emitting element included in the non-light-emitting pixel when the multiple color image is displayed on the display panel (S650). On the other hand, according to the method of FIG. 9, the processor may determine whether an average grayscale of the single color image is lower than or equal to a reference low-grayscale when the single color image is displayed on the display panel (S625). Here, when the average grayscale of the single color image displayed on the display panel is higher than the reference low-grayscale (e.g., when the single color image is the non-low-grayscale single color image), the method of FIG. 9 may apply the initialization voltage to the anode of the organic light-emitting element included in the non-light-emitting pixel (S650). On the other hand, when the average grayscale of the single color image displayed on the display panel is lower than or equal to the reference low-grayscale (e.g., when the single color image is the low-grayscale single color image), according to the method of FIG. 9, the processor may apply a lateral leakage prevention or reduction voltage that is higher than the initialization voltage to an anode of an organic light-emitting element included in an adjacent non-light-emitting pixel that is located within a set or reference distance from a light-emitting pixel (S630). Although the average grayscale of the single color image displayed on the display panel is lower than or equal to the reference low-grayscale (e.g., although the single color image is the low-grayscale single color image), according to the method of FIG. 9, the processor may apply the initialization voltage to an anode of an organic light-emitting element included in a non-adjacent non-light-emitting pixel that is located outside the set or reference distance from the light-emitting pixel (S640). As described above, the set or reference distance may be determined by considering influence between the light-emitting pixel and the non-light-emitting pixel. Thus, because the influence between the light-emitting pixel and the non-adjacent non-light-emitting pixel that is located outside the set or reference distance from the light-emitting pixel is little, the method of FIG. 9 may apply the initialization voltage to the non-adjacent non-light-emitting pixel that is located outside the set or reference distance from the light-emitting pixel.

In brief, the method of FIG. 9 may minimize (or reduce) the lateral leakage current flowing between the light-emitting pixel and the non-light-emitting pixel that are adjacent to each other when the low-grayscale single color image is displayed on the display panel by determining whether the single color image is displayed on the display panel or the multiple color image is displayed on the display panel, by applying the initialization voltage to the anode of the organic light-emitting element included in the non-light-emitting pixel when the multiple color image is displayed on the display panel or when the average grayscale of the single color image is higher than the reference low-grayscale although the single color image is displayed on the display panel, and by applying the lateral leakage prevention or reduction voltage to the anode of the organic light-emitting element included in the adjacent non-light-emitting pixel that is located within the set or reference distance from the light-emitting pixel when the single color image is displayed on the display panel and when the average grayscale of the single color image is lower than or equal to the reference low-grayscale. Thus, the method of FIG. 9 may prevent or reduce a phenomenon in which light-emission luminance of the light-emitting pixel does not reach desired luminance due to the lateral leakage current or the non-light-emitting pixel unintentionally emits light due to the lateral leakage current. As a result, the organic light-emitting display device employing the method of FIG. 9 may provide a high-quality image to a viewer (or user).

FIG. 10 is a block diagram illustrating an organic light-emitting display device according to example embodiments.

Referring to FIG. 10, the organic light-emitting display device 500 may include a display panel 510 and a display panel driving circuit 520.

The display panel 510 may include a plurality of pixels. Here, the pixels may include a plurality of first pixels each including an organic light-emitting element that outputs a first color light (e.g., a red color light), a plurality of second pixels each including an organic light-emitting element that outputs a second color light (e.g., a green color light), and a plurality of third pixels each including an organic light-emitting element that outputs a third color light (e.g., a blue color light). Here, each of the first through third pixels may include the organic light-emitting element and an organic light-emitting element driving circuit that drives the organic light-emitting element. For example, the organic light-emitting element circuit may include a switching transistor, a driving transistor, an initialization transistor, a storage capacitor, etc. In display panel 510, the first pixels, the second pixels, and the third pixels may be arranged adjacent to each other. Here, in the display panel 510, the first pixels, the second pixels, and the third pixels may be arranged in various structures. In an example embodiment, the first pixels may be arranged in a point symmetry with respect to the second pixel, the second pixels may be arranged in a point symmetry with respect to the first pixel and the third pixel, and the third pixels may be arranged in a point symmetry with respect to the second pixel. Based on this structure, the display panel 510 may display an image using the first color light output from the first pixels, the second color light output from the second pixels, and the third color light output from the third pixels.

The display panel driving circuit 520 may drive the display panel 510. For this operation, the display panel driving circuit 520 may include a scan driver, a data driver, a timing controller, etc. In some example embodiments, the display panel driving circuit 520 may further include an emission control driver. The display panel 510 may be connected to the data driver via a plurality of data-lines. The display panel 510 may be connected to the scan driver via a plurality of scan-lines. The display panel 510 may be connected to the emission control driver via a plurality of emission control-lines. Specifically, the data driver may provide a data signal DS to the display panel 510 via the data-lines, the scan driver may provide a scan signal SS to the display panel 510 via the scan-lines, and the emission control driver may provide an emission control signal ES to the display panel 510 via the emission control-lines. The timing controller may control the scan driver, the data driver, the emission control driver, etc. That is, the timing controller may generate a plurality of control signals to provide the control signals to the scan driver, the data driver, the emission control driver, etc. For example, the timing controller may perform a specific processing (e.g., data compensation, etc.) on the data signal input from an external component. In example embodiments, the display panel driving circuit 520 may further include a lateral leakage current reduction circuit 525 that minimizes (or reduces) a lateral leakage current flowing between a light-emitting pixel and a non-light-emitting pixel that are adjacent to each other when a single color image or a low-grayscale single color image is displayed on the display panel 510. In some example embodiments, the lateral leakage current reduction circuit 525 may be implemented externally to the display panel driving circuit 520.

In an example embodiment, the lateral leakage current reduction circuit 525 may determine whether the single color image is displayed on the display panel 510 or the multiple color image is displayed on the display panel 510, may apply an initialization voltage to an anode of an organic light-emitting element included in the non-light-emitting pixel when the multiple color image is displayed on the display panel 510, may apply a lateral leakage prevention or reduction voltage that is higher than the initialization voltage to an anode of an organic light-emitting element included in an adjacent non-light-emitting pixel that is located within a set or reference distance from the light-emitting pixel when the single color image is displayed on the display panel 510. In another example embodiment, the lateral leakage current reduction circuit 525 may determine whether the single color image is displayed on the display panel 510 or the multiple color image is displayed on the display panel 510, may apply an initialization voltage to an anode of an organic light-emitting element included in the non-light-emitting pixel when the multiple color image is displayed on the display panel 510 or when an average grayscale of the single color image is higher than a reference low-grayscale although the single color image is displayed on the display panel 510, and may apply a lateral leakage prevention or reduction voltage that is higher than the initialization voltage to an anode of an organic light-emitting element included in an adjacent non-light-emitting pixel that is located within a set or reference distance from the light-emitting pixel when the single color image is displayed on the display panel 510 and when the average grayscale of the single color image is lower than or equal to the reference low-grayscale. Because these are described above with reference to FIGS. 1 to 9, duplicated description related thereto will not be repeated.

Figure 11:
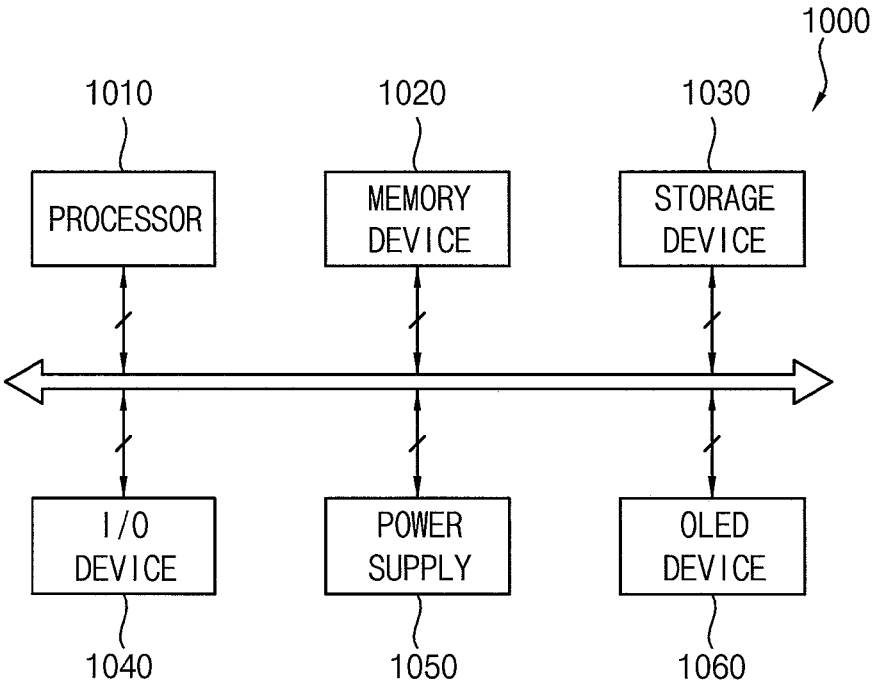
FIG. 11 is a block diagram illustrating an electronic device according to example embodiments.
Figure 12:
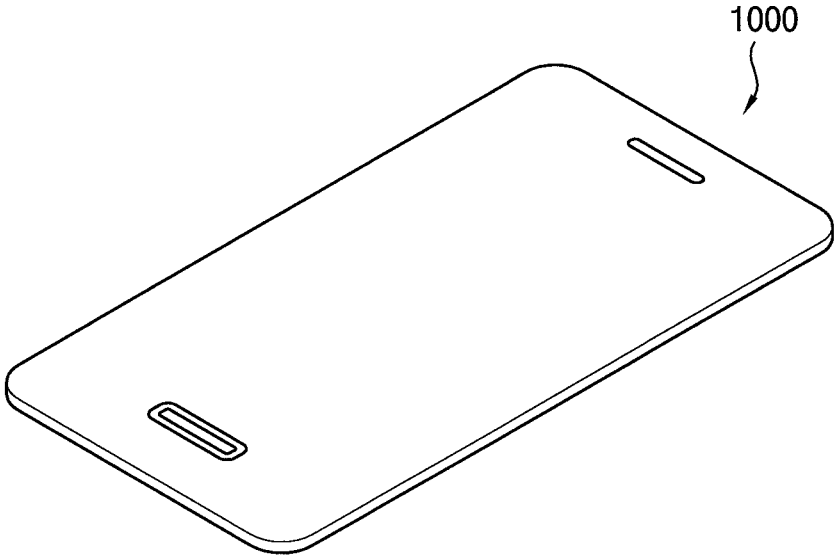
FIG. 12 is a diagram illustrating an example in which the electronic device of FIG. 11 is implemented as a smart phone.

FIG. 11 is a block diagram illustrating an electronic device according to example embodiments, and FIG. 12 is a diagram illustrating an example in which the electronic device of FIG. 11 is implemented as a smart phone.

Referring to FIGS. 11 and 12, the electronic device 1000 may include a processor 1010, a memory device 1020, a storage device 1030, an input/output (I/O) device 1040, a power supply 1050, and an organic light-emitting display device 1060. Here, the organic light-emitting display device 1060 may be the organic light-emitting display device 500 of FIG. 10. In addition, the electronic device 1000 may further include a plurality of ports for communicating with a video card, a sound card, a memory card, a universal serial bus (USB) device, other electronic devices, etc. In an example embodiment, as illustrated in FIG. 12, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a head mounted display (HMD) device, etc.

The processor 1010 may perform various computing functions. The processor 1010 may be a micro-processor, a central processing unit (CPU), an application processor (AP), etc. The processor 1010 may be coupled to other components via an address bus, a control bus, a data bus, etc. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc and/or at least one volatile memory device such as a dynamic random access memory (DRAM) device, a static random access memory (SRAM) device, a mobile DRAM device, etc. The storage device 1030 may include a solid state drive (SSD) device, a hard disk drive (HDD) device, a CD-ROM device, etc. The I/O device 1040 may include an input device such as a keyboard, a keypad, a mouse device, a touch-pad, a touch-screen, etc, and an output device such as a printer, a speaker, etc. The power supply 1050 may provide power for operations of the electronic device 1000.

The organic light-emitting display device 1060 may be coupled to other components via the buses or other communication links. In some example embodiments, the organic light-emitting display device 1060 may be included in the I/O device 1040. As described above, the organic light-emitting display device 1060 may include a lateral leakage current reduction circuit that minimizes (or reduces) a lateral leakage current flowing between a light-emitting pixel and a non-light-emitting pixel that are adjacent to each other when a single color image or a low-grayscale single color image is displayed on a display panel. In an example embodiment, the lateral leakage current reduction circuit may apply a lateral leakage prevention or reduction voltage to an anode of an organic light-emitting element included in an adjacent non-light-emitting pixel that is located within a set or reference distance from the light-emitting pixel when the single color image is displayed on the display panel of the organic light-emitting display device 1060. In another example embodiment, the lateral leakage current reduction circuit may apply a lateral leakage prevention or reduction voltage to an anode of an organic light-emitting element included in an adjacent non-light-emitting pixel that is located within a set or reference distance from a light-emitting pixel when the low-grayscale single color image is displayed on the display panel of the organic light-emitting display device 1060. As a result, in the organic light-emitting display device 1060, the lateral leakage current flowing between the light-emitting pixel and the non-light-emitting pixel that are adjacent to each other when the single color image or the low-grayscale single color image is displayed on the display panel may be minimized (or reduced), and thus a problem in which light-emission luminance of the light-emitting pixel does not reach desired luminance or the non-light-emitting pixel unintentionally emits light may be prevented or reduced. Because these are described above, duplicated description related thereto will not be repeated.

The present inventive concept may be applied to an organic light-emitting display device and an electronic device including the organic light-emitting display device. For example, the present inventive concept may be applied to a cellular phone, a smart phone, a video phone, a smart pad, a smart watch, a tablet PC, a car navigation system, a television, a computer monitor, a laptop, a head mounted display (HMD) device, an MP3 player, etc.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing aspects of some example embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

The foregoing is illustrative of example embodiments and is not to be construed as limiting thereof. Although a few example embodiments have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A method of driving a display panel in an organic light-emitting display device, the display panel comprising a first pixel configured to output a first color light, a second pixel configured to output a second color light, and a third pixel configured to output a third color light, the method comprising:

determining whether or not a single color image that is implemented by one of the first color light, the second color light, and the third color light is displayed on the display panel or a multiple color image that is implemented by at least two of the first color light, the second color light, and the third color light is displayed on the display panel;

applying an initialization voltage, for initializing an anode of an organic light-emitting element included in a non-light-emitting pixel, to the anode of the organic light-emitting element included in the non-light-emitting pixel when the multiple color image is displayed on the display panel; and applying a lateral leakage prevention voltage that is higher than the initialization voltage to an anode of an organic light-emitting element included in an adjacent non-light-emitting pixel that is located within a reference distance from a light-emitting pixel when the single color image is displayed on the display panel.

2. The method of claim 1, further comprising:

applying the initialization voltage to an anode of an organic light-emitting element included in a non-adjacent non-light-emitting pixel that is located outside the reference distance from the light-emitting pixel when the single color image is displayed on the display panel.

3. The method of claim 1, wherein applying the lateral leakage prevention voltage comprises:

deriving a driving current that is required to flow into the organic light-emitting element for a voltage of the anode of the organic light-emitting element included in the adjacent non-light-emitting pixel to be equal to the lateral leakage prevention voltage;

deriving a data voltage corresponding to the driving current; and applying the data voltage to the adjacent non-light-emitting pixel.

4. The method of claim 1, wherein the first color light is a red color light, the second color light is a green color light, and the third color light is a blue color light.

5. The method of claim 1, wherein the lateral leakage prevention voltage is lower than a predetermined low-grayscale data voltage.

6. The method of claim 5, wherein the lateral leakage prevention voltage applied to the first pixel, the lateral leakage prevention voltage applied to the second pixel, and the lateral leakage prevention voltage applied to the third pixel are equal to each other.

7. The method of claim 5, wherein the lateral leakage prevention voltage applied to the first pixel, the lateral leakage prevention voltage applied to the second pixel, and the lateral leakage prevention voltage applied to the third pixel are different from each other.

8. The method of claim 5, wherein the lateral leakage prevention voltage is configured to be constant regardless of a data voltage applied to the light-emitting pixel.

9. The method of claim 5, wherein the lateral leakage prevention voltage is configured to vary according to a data voltage applied to the light-emitting pixel.

10. The method of claim 9, wherein the lateral leakage prevention voltage is configured to increase as the data voltage increases, and the lateral leakage prevention voltage is configured to decrease as the data voltage decreases.

11. A method of driving a display panel in an organic light-emitting display device, the display panel comprising a first pixel configured to output a first color light, a second pixel configured to output a second color light, and a third pixel configured to output a third color light, the method comprising:

determining whether or not a single color image that is implemented by one of the first color light, the second color light, and the third color light is displayed on the display panel or a multiple color image that is implemented by at least two of the first color light, the second color light, and the third color light is displayed on the display panel;

applying an initialization voltage, for initializing an anode of an organic light-emitting element included in a non-light-emitting pixel, to the anode of the organic light-emitting element included in the non-light-emitting pixel when the multiple color image is displayed on the display panel or when an average grayscale of the single color image is higher than a reference low-grayscale although the single color image is displayed on the display panel; and applying a lateral leakage prevention voltage that is higher than the initialization voltage to an anode of an organic light-emitting element included in an adjacent non-light-emitting pixel that is located within a reference distance from a light-emitting pixel when the single color image is displayed on the display panel and when the average grayscale of the single color image is lower than or equal to the reference low-grayscale.

12. The method of claim 11, further comprising:

applying the initialization voltage to an anode of an organic light-emitting element included in a non-adjacent non-light-emitting pixel that is located outside the reference distance from the light-emitting pixel when the single color image is displayed on the display panel and when the average grayscale of the single color image is lower than or equal to the reference low-grayscale.

13. The method of claim 11, wherein applying the lateral leakage prevention voltage comprises:

deriving a driving current that is required to flow into the organic light-emitting element for a voltage of the anode of the organic light-emitting element included in the adjacent non-light-emitting pixel to be equal to the lateral leakage prevention voltage;

deriving a data voltage corresponding to the driving current; and applying the data voltage to the adjacent non-light-emitting pixel.

14. The method of claim 11, wherein the first color light is a red color light, the second color light is a green color light, and the third color light is a blue color light.

15. The method of claim 11, wherein the lateral leakage prevention voltage is lower than a predetermined low-grayscale data voltage.

16. The method of claim 15, wherein the lateral leakage prevention voltage applied to the first pixel, the lateral leakage prevention voltage applied to the second pixel, and the lateral leakage prevention voltage applied to the third pixel are equal to each other.

17. The method of claim 15, wherein the lateral leakage prevention voltage applied to the first pixel, the lateral leakage prevention voltage applied to the second pixel, and the lateral leakage prevention voltage applied to the third pixel are different from each other.

18. The method of claim 15, wherein the lateral leakage prevention voltage is configured to be constant regardless of a data voltage applied to the light-emitting pixel.

19. The method of claim 15, wherein the lateral leakage prevention voltage is configured to vary according to a data voltage applied to the light-emitting pixel.

20. The method of claim 19, wherein the lateral leakage prevention voltage is configured to increase as the data voltage increases, and the lateral leakage prevention voltage is configured to decrease as the data voltage decreases.

* * * * *